United States Patent [19]

Daniels et al.

[11] 4,446,200

[45] May 1, 1984

[54] METALLURGICAL COATING SYSTEM

[75] Inventors: Larry C. Daniels; Gary S. Whittaker, both of Kingsport, Tenn.

[73] Assignee: Eastman Kodak Company, Rochester, N.Y.

[21] Appl. No.: 523,491

[22] Filed: Aug. 15, 1983

[51] Int. Cl.[3] ..... B32B 15/04

[52] U.S. Cl. ..... 428/661; 428/662; 428/663; 428/680; 428/926

[58] Field of Search ..... 428/641, 661, 662, 663, 428/680, 926, 938

[56] References Cited

U.S. PATENT DOCUMENTS

| | | | |
|---|---|---|---|
| 2,966,738 | 1/1961 | Bertossa | 428/661 |
| 3,226,207 | 12/1965 | Bungardt et al. | 428/941 |
| 3,307,925 | 3/1967 | Jacobson | 428/661 |
| 4,190,493 | 2/1980 | Yee | 428/680 |
| 4,293,619 | 10/1981 | Landingbran | 428/661 |
| 4,369,233 | 1/1983 | van Schaik | 428/680 |

FOREIGN PATENT DOCUMENTS

| | | | |
|---|---|---|---|
| 48-15778 | 5/1973 | Japan | 428/641 |

*Primary Examiner*—Michael L. Lewis

*Attorney, Agent, or Firm*—David E. Cotey; Daniel B. Reece, III

[57] ABSTRACT

The present invention relates to a novel metallurgical coating system which provides corrosion resistance and non-stick properties to metallic components which are subjected to unusually severe operating conditions. The coating system comprises a first layer comprising tantalum which is deposited upon a substrate and a second layer comprising molybdenum disilicide which is deposited upon the first layer.

8 Claims, No Drawings

METALLURGICAL COATING SYSTEM

DESCRIPTION

BACKGROUND OF THE INVENTION

The present invention relates to a novel metallurgical coating system which affords a degree of protection hitherto unavailable to metallic components which are subjected to unusually severe operating conditions. In particular, the coating system is especially useful in severe chemical environments in which corrosion resistance and non-stick properties are desirable.

Materials which provide effective resistance to ordinary problems of corrosion are well-known in the art. Such materials include, for example, the various stainless steels and other steel alloys.

It also is known that other materials providing greater resistance to corrosion are available for use in environments where corrosion is a more severe problem. One class of materials which has been shown to be useful in such environments is the class of nickel-base alloys. In addition to nickel, such alloys typically contain varying amounts of molybdenum, chromium, iron, and other metals. Particularly effective are nickel-base alloys which contain relatively large percentages of molybdenum. While the materials described above perform well for their intended applications, it has been found that these materials suffer undesirably rapid and extensive corrosion and failure under extremely severe operating conditions. We have now found that the problem of corrosion in severe chemical environments can be mitigated by the use of the unique coating system described herein.

SUMMARY OF THE INVENTION

The present invention provides a metallurgical coating system which provides improved corrosion resistance. The coating system comprises a first layer comprising tantalum which is deposited upon a substrate and a second layer comprising molybdenum disilicide which is deposited upon the first layer.

DETAILED DESCRIPTION OF THE INVENTION

The present invention provides a metallurgical coating system which is especially useful in severe chemical environments, such as those found in certain chemical plants and elsewhere. The coating system of the present invention is especially useful in environments where corrosion resistance and non-stick properties are desirable.

The coating system of the present invention is employed in conjunction with a substrate which is subjected to relatively severe operating conditions. Such a substrate typically will itself be a corrosion resistant material, such as nickel base alloys, steel alloys having a high molybdenum content (i.e., above about 1% molybdenum), the Inconel® alloys, etc. The preferred substrates for use in conjunction with the present invention are nickel base alloys. Especially preferred are nickel base alloys having a relatively high molybdenum content (i.e., a molybdenum content above about 5% by weight). Such substrates are exemplified by materials such as Hastelloy® B-2, Hastelloy® C-276, Hastelloy® G, etc. Of course, alloys and other corrosion resistant materials equivalent to the specific materials enumerated above are also suitable for use in the coating system of the present invention.

The coating system of the present invention further comprises a first layer which is deposited upon the substrate. The first layer comprises tantalum and is preferably less than about 5 microns in thickness. It has been found that as the tantalum layer increases in thickness, the weakness of the layer also increases. Therefore, it is desirable to minimize the thickness of the tantalum layer. However, when the thickness of the tantalum layer is less than about 1 micron, it is likely that the advantageous protectiveness of the layer may be sacrificed.

The coating system of the present invention further comprises a second layer which is deposited upon the first layer. The second layer comprises molybdenum disilicide ($MoSi_2$) and is preferably about 1 to 25 microns in thickness. Preferably, the second layer is about 10 to 25 microns in thickness. At thicknesses above 25 microns, the coating system exhibits an undesirably high porosity due to the difficulty of controlling the structure of relatively thick layers. While it is typically desirable to have a minimum thickness of the second layer of about 10 microns, it is possible to employ a second layer as thin as one micron, depending upon the wear applications to which the coated object is to be subjected. The optimal thickness of both the first layer and the second layer will be apparent to the person of ordinary skill in the art.

The respective layers of the coating system of the present invention can be applied by any of the metal coating techniques which are known in the art. The manner in which the respective layers are deposited upon the substrate is not critical to the present invention. Methods which are currently available for forming coatings of the thickness described above and which are preferred for use in conjunction with the present invention include sputtering techniques and evaporation techniques. Specific sputtering techniques which are especially preferred include RF sputtering, DC sputtering, magnetron sputtering, ion beam sputtering, etc. Another desirable technique for use in conjunction with the present invention is ion plating. While a number of specific techniques for forming the coating system of the present invention have been mentioned, it is to be understood that this list is not exhaustive and that other suitable techniques which are presently known or which may be developed may also be used to advantage. Each of the processes enumerated above is well known to the skilled artisan, and details of such processes including equipment, procedure, etc., can be found elsewhere in the literature and need not be given here.

The coating system which has been described above has been found to be highly advantageous for use in severe chemical environments where corrosion of metal components is a significant problem. Thus, the coating system of the present invention can be used in the fabrication of such components as valves, pumps, reactors, and subsidiary parts thereof which are subjected to highly corrosive environments. Specifically, contemplated uses include valve balls, let-down valves, high rpm pumps and other readily apparent applications.

In addition to improvements in corrosion resistance which are provided by the present invention, it has unexpectedly been found that the coating system of the present invention provides superior non-stick properties. This unique combination of properties of the coating system of the present invention would indicate that it would be highly useful in environments which are corrosive and sticky (or tacky), such as polymer reactors.

While not wishing to be bound by theoretical considerations, it is believed that the unique and highly advantageous combination of properties provided by the coating system of the present invention is due to the particular arrangement of the layers of the coating system. In particular, it is believed that the tantalum layer, when applied to the preferred nickel base alloys, provides a combination of good corrosion resistance and good adhesion to the substrate and to the second layer (i.e., the $MoSi_2$ layer). However, the tantalum layer by itself is too soft to be of any practical value as a coating in a severe chemical environment. Moreover, it was further found that a molybdenum disilicide layer applied directly to a preferred substrate, such as that described above, exhibited poor adhesion as evidenced by peeling and cracking of the coating. However, it was unexpectedly found that the molybdenum disilicide layer applied on top of the tantalum layer provided a coating system which exhibited good adhesion and excellent corrosion resistance. As mentioned above, this unique combination surprisingly also provided extremely good non-stick properties.

While the present invention has been described in detail with reference to preferred embodiments thereof, it will be understood that variations and modifications can be effected within the spirit and scope of the invention.

We claim:

1. A metallurgical coating system which provides improved corrosion resistance comprising (a) a first layer comprising tantalum which is deposited under a substrate; and (b) a second layer comprising molybdenum disilicide which is deposited upon said first layer.

2. The coating system of claim 1 wherein said substrate comprises a nickel base alloy.

3. The coating system of claim 2 wherein said nickel base alloy has a molybdenum content of at least about 5% by weight.

4. The coating system of claim 1 wherein said first layer is provided at a thickness of less than about 5μ.

5. The coating system of claim 1 wherein said second layer is provided at a thickness of about 1 to 25μ.

6. The coating system of claim 4 wherein said second layer is provided at a thickness of about 10 to 25μ.

7. The coating system of claim 1 wherein said first and second layers are deposited by a coating process selected from sputtering techniques and evaporation techniques.

8. A metallurgical coating system which provides improved corrosion resistance comprising (a) a nickel base alloy having a molybdenum content of at least about 5% by weight;

(b) a first coating layer deposited upon said substrate at a thickness less than about 5μ, said first layer comprising tantalum; and (c) a second coating layer deposited upon said first layer at a thickness of about 10 to 25μ, said second layer comprising molybdenum disilicide.

* * * * *